US005782127A

United States Patent [19]

Donini et al.

[11] Patent Number: 5,782,127

[45] Date of Patent: Jul. 21, 1998

[54] DEVICE FOR THE AXIAL SHIFTING OF ROLLING ROLLS

[75] Inventors: Estore Donini, Vimercate; Cesare Galletti, Segrate S. Felice; Fausto Drigani, Zugliano, all of Italy

[73] Assignee: Danieli & C. Officine Meccaniche SpA, Buttrio, Italy

[21] Appl. No.: 668,681

[22] Filed: Jun. 24, 1996

[30] Foreign Application Priority Data

Jun. 26, 1995 [IT] Italy ..... UD95A0127

[51] Int. Cl.[6] ..... B21B 31/07; B21B 31/18

[52] U.S. Cl. ..... 72/247; 72/237

[58] Field of Search ..... 72/247, 240, 248, 72/237, 238, 241.2, 241.4, 241.8, 239

[56] References Cited

FOREIGN PATENT DOCUMENTS 0506138 9/1992 European Pat. Off. .
0553480 8/1993 European Pat. Off. .

OTHER PUBLICATIONS

Patent Abstracts of Japan, vol. 950, No. 003 & JP-A-07-060310 (Mitsubishi Heavy Ind. Ltd.) 7 Mar. 1995.
Patent Abstracts of Japan, vol. 018, No. 594 (M-1703), 14 Nov. 1994 & JP-A-06 226304 (Hitachi, Ltd.) 16 Aug. 1994.
Patent Abstracts of Japan, vol. 018, No. 051 (M-1548), 26 Jan. 1994 & JP-A-05 277526 (Mitsubishi Heavy Ind) 26 Oct. 1993.
Patent Abstracts of Japan, vol. 018, No. 051 (M-1548), 26 Jan. 1994 & JP-A-05 277 527 (Mitsubishi Heavy Ind) 26 Oct. 1993.
Patent Abstracts of Japan, vol. 011, No. 114 (M-579) 10 Apr. 1987 & JP-A-61 259812 (Ishikawajima Harima Heavy) 18 No. 1986.
Patent Abstracts of Japan, vol. 003, No. 003 (C-033) 16 Jan. 1979 & JP-A-53 127353 (Ishikawajima Harima Heavy) 7 Nov. 1978.
Database WPI, Section PQ, week 7804, Derwent Publications Ltd GB; Class P 51, AN 78-A8088A [04] & SU-A-544491 (Kazakevich) Feb. 1977.

*Primary Examiner*—Lowell A. Larson
*Assistant Examiner*—Rodney Butler
*Attorney, Agent, or Firm*—Antonelli, Terry, Stout & Kraus, LLP

[57] ABSTRACT

Device for the axial shifting of rolling rolls in a rolling mill stand of a four-high type for the production of strip and/or plate, the stand being equipped with means for the reciprocal cross-over displacement of the processing rolls (10) on a plane parallel to the rolling plane, each roll (10) being borne on relative chocks (11) associated with stationary housings (12), a shifting jack (24) being included and being anchored at one end to a stationary housing (12) and at the other end to an erection element (31), jaw means (15) being included for the temporary clamping of the erection element (31) to a chock (11), the engagement surfaces of the jaw means (15) cooperating in the engagement position (15*a*) with engagement means included at least on the sides of the chock (11), these latter engagement means being conformed as a sliding element (28) having at least a first position and a second position in relation to the engagement surfaces (29, 30) of the jaw means (15), these first and second positions depending on the aligned and/or inclined position of the roll (10) in relation to its initial longitudinal axis (19), the engagement surfaces (29, 30) of the jaw means (15) being conformed as an arc of a circumference the centre of which (32) lies on the median plane of the relative rolling roll (10).

4 Claims, 3 Drawing Sheets

DEVICE FOR THE AXIAL SHIFTING OF ROLLING ROLLS

BACKGROUND OF THE INVENTION

This invention concerns also a method for the axial shifting of rolling rolls with a reciprocal cross-over displacement of the rolls.

To be more exact, the invention is applied in the performance of an axial movement of shifting of the processing rolls in a rolling mill stand of a four-high type for the production of strip and/or plate, the stand arranging the reciprocal cross-over displacement of the rolls.

The state of the art covers rolling mill stands of a four-high type to produce strip and/or plate which include respective opposed upper and lower processing rolls defining a rolling plane and fitted to relative chocks positioned at one side and the other of the rolling mill stand.

The state of the art covers also the need to arrange, during the rolling cycle or between one cycle and another cycle, a movement of parallel shifting of the rolling rolls so as to change their processing surfaces, thus preventing the formation of more greatly worn zones on the surfaces of the rolls and, in particular, at the edges of the strip being rolled.

In the state of the art each roll cooperates with relative jack means performing axial displacement, and jaw means are normally included which engage the chock bearing the roll and make possible the shifting of the roll.

The state of the art also covers the requirement that to optimise the working of the rolls in a four-high rolling mill stand a shifting of the rolls is induced on the rolling plane, thus causing a reciprocal cross-over positioning of the rolls at very small angles, from 1.5° to 2.5° as a maximum.

The systems of the state of the art for the parallel shifting of the rolls are not compatible with this crossover shifting inasmuch as the inclusion of the jaws or other systems normally employed for engagement between the shifting devices and the relative chock, these systems being engaged on the lateral sides of the chocks, do not make possible a travel of lateral displacement of the chocks.

The present applicants have designed, tested and embodied this invention to overcome the shortcomings of the state of the art and to achieve further advantages.

Summary Of The Invention

The purpose of this invention is to provide a device for the shifting of the rolling rolls in a four-high rolling mill stand for the production of strip and/or plate, this device arranging a reciprocal cross-over displacement of the rolls.

This cross-over displacement normally displaces the roll in one single direction and determines for the roll a first position aligned with, and at least one second position inclined to, the original axis of positioning.

The other roll therefore will have a first aligned position and at least a second position inclined in the opposite direction to the inclined position of the first roll.

Moreover, in this cross-over shifting only one of the rolls may be inclined or both of the rolls may be inclined at the same time.

The step of parallel shifting may be simultaneous with that of the cross-over displacement or may be carried out at a different moment.

According to the invention, engagement means conformed as sliding elements are included at the sides of the chocks bearing the rolls and in the zone of engagement of the chocks by the jaws.

These engagement means determine, in relation to the surface of engagement of the jaws, at least two positions which coincide respectively with the position of a substantially straight roll and with the limit position of inclination which the roll may take up in its movement of cross-over displacement in relation to the other roll.

According to the invention the engagement surfaces of the jaws are conformed as an arc of a circumference, the centre of which lies on the transverse median plane of the roll.

According to a variant the chock has its end conformed substantially as a dove-tail so as to facilitate cooperation between the jaws and the engagement means included on the sides of the chocks in the variable positioning.

As an alternative to the jaws, other known engagement systems may be used for the parallel shifting of the rolls and be suitable for cooperating with the engagement means conformed as sliding elements present on the sides of the chocks.

BRIEF DESCRIPTION OF THE DRAWING

The attached figures are given as a non-restrictive example and show some preferred embodiments of the invention as follows.

DETAILED DESCRIPTION OF THE PREFERRED EMBODIMENTS

Figure 1:
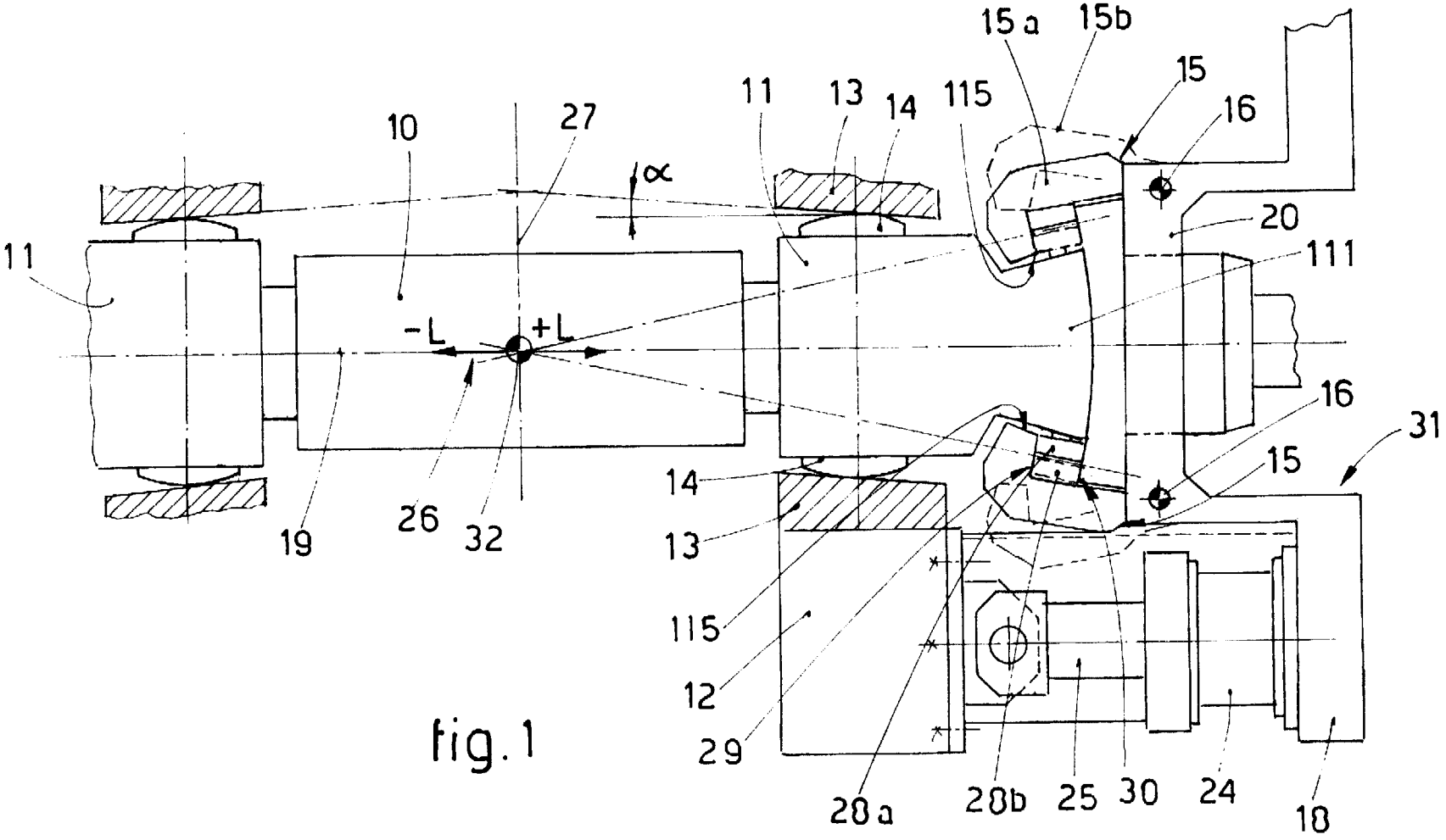
FIG. 1 is a partial view from above of a roll of a rolling mill stand in association with the shifting device according to the invention.
Figure 2:
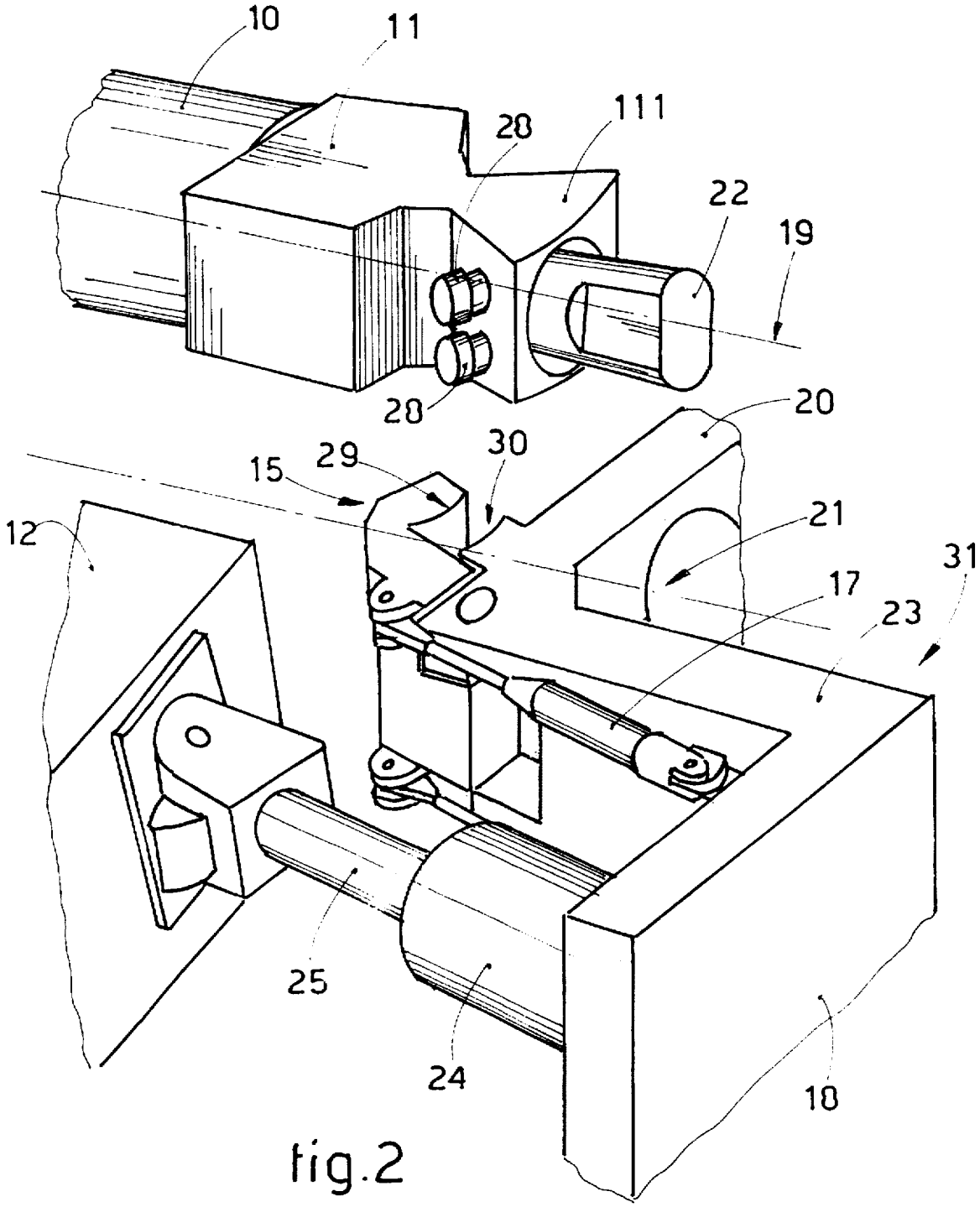
FIG. 2 is a knock-down partial three-dimensional view of the device of FIG. 1.

A rolling roll 10 shown in FIG. 1 is borne at its ends by supporting chocks 11 associated laterally with stationary housings 12.

In the example shown in FIG. 1 positioning cradles 14 are included between the chocks 11 and the relative stationary housings 12 and have an at least partly rounded conformation and cooperate with abutment blocks 13 conformed with an inclined surface for the purpose of causing the required movement of reciprocal cross-over displacement of the rolls 10.

Figure 3:
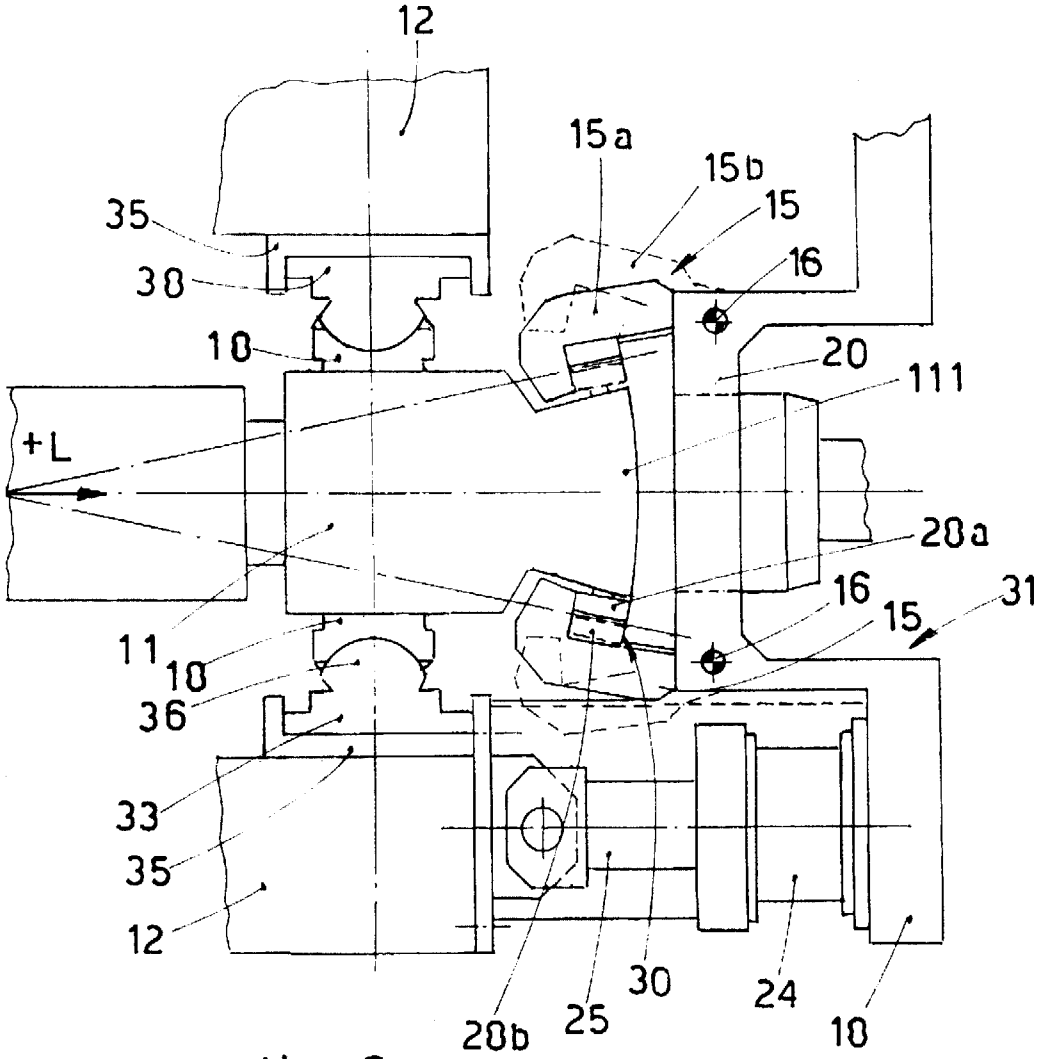
FIG. 3 is a variant of FIG. 1.
Figure 4:
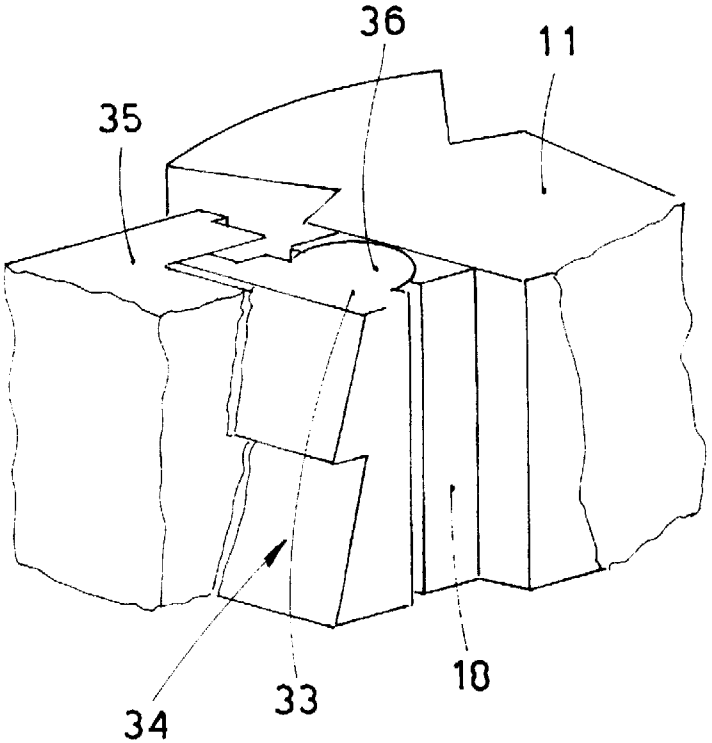
FIG. 4 is a partial three-dimensional view of the embodiment of FIG. 3.

In the variant of FIGS. 3 and 4 a vertically movable slider 33 cooperating with an abutment block 35 is included between the chocks 11 and the stationary housings 12.

This movable slider 33 has an outer wedge-shaped conformation 34, which cooperates with a mating wedge-shaped conformation on the inner surface of the abutment block 35.

Moreover, in this case the movable slider 33 has on its inner side an at least partly spherical surface 36, which cooperates with a positioning seating of a mating form provided in the positioning cradle 18.

Cooperation between the wedge-shaped conformation of the movable slider 33 and that of the inner surface of the abutment block 35 causes, upon each vertical displacement of the movable slider 33, a mating lateral displacement of the relative roll 10, thus causing the required cross-over displacement.

In this example the device for the axial shifting of the rolling rolls 10 comprises jaw means 15 located on one side and on the other side of at least one of the chocks 11 supporting the roll 10.

These jaw means 15 have a first engagement position 15a and at least one second inactive position 15b shown partly with lines of dashes in FIG. 1.

The jaw means 15 can rotate about relative pivots 16 owing to the action of first actuation jacks 17.

The jaw means 15 are anchored to an erection element 31 comprising a first plate 20, which during assembly is fitted in a position close to the chock 11 on the same axis as the longitudinal axis 19 of the roll 10.

This first plate 20 contains a through hole 21 for insertion of the shaft 22 of the roll 10 and of the means for connection to the motor means.

The erection element 31 also comprises, for each side of the chock 11, a second connecting plate 23 which connects the first plate 20 to a laterally protruding base plate 18 to which the first actuation jacks 17 are anchored.

To the base plate 18 is also secured a second jack 24 for shifting the rolls 10, the stem 25 of the jack 24 being solidly fixed to the stationary housing 12.

During working, the jaw means 15 are closed against the chock 11 at the position 15a, thus solidly connecting the erection element 31 to the chock 11.

The second shifting jack 24 is then actuated and displaces the roll 10 axially in relation to the stationary housing 12 and according to one or the other of the directions shown by the arrows 26.

This displacement can be carried out, according to the invention, along a length "L" of about +250 to 400 mm. in relation to the original axis of positioning 27.

According to the invention, in the embodiment shown in FIG. 1, owing to the conformation of the positioning cradle 14 and of the abutment block 13 associated with that cradle 14, this axial displacement causes the resulting cross-over displacement of the roll 10 in relation to the direction of shifting imparted by the second jack 24.

In this case, according to the invention, the engagement means on the chocks 11 which engage the jaw means 15 are conformed as sliding elements 28 so as to make possible the cross-over displacement.

In this example these sliding means 28 are conformed as rollers, but other embodiments can employ slide blocks, bearings or other like embodiments.

In this way the axial thrusts generated by the reciprocal cross-over displacement of the rolls 10 are fully discharged onto sliding elements having a very low coefficient of friction.

These roller-type sliding elements 28 are fitted to the lateral sides of the end element 111 of the chock 11.

In this case the respective engagement surfaces 29 and 30 of the jaw means 15 act as a sliding guide and path on which the roller sliding elements 28 can be displaced, thus defining a plurality of positions according to the cross-over displacement of the rolls 10 and to the direction of that cross-over displacement.

In this connection the engagement surfaces 29 and 30 of the jaw means 15 are conformed as an arc of a circumference the centre of which 32 lies on the median transverse plane of the roll 10.

The roller-type sliding elements 28 have a first position 28a on the engagement surfaces 29, 30, this position corresponding to a substantially straight position of the relative roll 10, and at least one respective second limit position 28b (shown with lines of dashes in FIG. 1) on the engagement surfaces 29, 30 of the jaw means 15, this position corresponding to the maximum cross-over displacement permitted for the rolls 10.

According to the value "a" of the cross-over displacement of the rolls 10 correlated with the length of the shifting of those rolls 10, the roller-type sliding elements 28 can take up intermediate positions between the limit positions 28a and 28b.

The end element Ill of the chock 11 is conformed as a dove-tail advantageously to assist cooperation of the jaw means 15 with the roller-type sliding elements 28; in particular, the displacement of the roller-type sliding elements 28 along the whole extent of the engagement surfaces 29 and 30 is possible without the side of the end element 119 of the chock 11 coming into contact with the front part 115 of the jaw means 15.

We claim:

1. Device for the axial shifting of rolling rolls in a rolling mill stand of a four-high type for the production of strip and/or plate, the stand being equipped with means for the reciprocal cross-over displacement of the processing rolls on a plane parallel to the rolling plane, each roll being borne on relative chocks associated with stationary housings, a shifting jack being included and being anchored at one end to a stationary housing and at the other end to an erection element jaw means being included for the temporary clamping of the erection element to a chock, the jaw means having engagement surfaces cooperating in an engagement position with engagement means included at least on sides of the chock, the device being characterised in that these latter engagement means are conformed as a sliding element having at least a first position and a second position in relation to the engagement surfaces of the jaw means, these first and second positions depending on the aligned and/or inclined position of the roll in relation to its initial longitudinal axis, the device being characterised in that the engagement surfaces of the jaw means are conformed as an arc of a circumference the centre of which lies on a median plane of the relative rolling roll.

2. Device as in claim 1, in which the sliding elements comprise rollers fitted to an end element of the chock that end element of the chock being conformed as a dovetail with a zone of a reduced width for cooperation with an end of the jaw means.

3. A four-high rolling mill stand, comprising:

a pair of processing rolls borne at their ends by relative chocks and defining a rolling plane therebetween;

stationary housings provided on lateral sides of the chocks of at least one of the pair of processing rolls, the stationary housings being conformed to impart a cross-over displacement to the at least one processing roll on a plane parallel to the rolling plane when the at least one processing roll is axially shifted;

an erection element;

a shifting jack anchored at one end to one of the stationary housings and at another end to the erection element; and a jaw element connected to the erection element and having an active position for temporarily clamping one chock of the at least one processing roll and an inactive position, the jaw element having engagement surfaces for engaging in the active position at least one sliding element of the one chock, the engagement surfaces being conformed as an arc of a circumference having a center which lies on a median plane of the at least one processing roll;

whereby, temporary clamping of the one chock by the jaw element in the active position and actuation of the shifting jack axially shifts the at least one processing roll and imparts a cross-over displacement of the at least one processing roll on a plane parallel to the rolling plane, and wherein the at least one sliding element has at least a first position and a second position in relation to the engagement surfaces of the jaw element, the at least first and second positions depending on the aligned and/or inclined position of the at least one processing roll in relation to its initial longitudinal axis.

4. A four-high rolling mill stand as in claim 3, wherein the at least one sliding element comprises rollers fitted to an end element of the one chock, the end element of the one chock being conformed as a dovetail with a zone of a reduced width for cooperation with an end of the jaw element.

* * * * *